United States Patent [19]

Konno et al.

[11] Patent Number: 4,844,023

[45] Date of Patent: Jul. 4, 1989

[54] VALVE OPERATING DEVICE FOR INTERNAL COMBUSTION ENGINE

[75] Inventors: Tsuneo Konno; Takashi Sugai, both of Saitama, Japan

[73] Assignee: Honda Giken Kogyo Kabushiki Kaisha, Tokyo, Japan

[21] Appl. No.: 142,830

[22] Filed: Jan. 11, 1988

[30] Foreign Application Priority Data

Jan. 8, 1987 [JP] Japan ..... 62-2455
Jan. 8, 1987 [JP] Japan ..... 62-2456

[51] Int. Cl.[4] ..... F01L 1/34; F01L 1/18

[52] U.S. Cl. ..... 123/90.16; 123/90.17; 123/90.44

[58] Field of Search ..... 123/90.16, 90.17, 90.22, 123/90.39, 90.40, 90.44, 198 E

[56] References Cited

U.S. PATENT DOCUMENTS 4,556,025 12/1985 Morita ..... 123/198 F
4,617,880 10/1986 Yoshizaki ..... 123/90.16
4,627,391 12/1986 Derringer ..... 123/90.16
4,690,110 9/1987 Nishimura et al. ..... 123/90.17
4,726,332 2/1988 Nishimura et al. ..... 123/90.16

*Primary Examiner*—Willis R. Wolfe
*Attorney, Agent, or Firm*—Lyon & Lyon

[57] ABSTRACT

A valve operating device for an internal combustion engine having a drive rocker arm operatively associated with an intake or exhaust valve and a free rocker arm releasable from the intake or exhaust valve. The drive rocker arm and the free rocker arm are disposed adjacent to each other and operable selectively in mutually different modes according to the rotation of the camshaft. In one embodiment either the drive or free rocker arm has two arms connected together with one arm on each side of the other rocker arm for balanced loading. A selective coupling mechanism is disposed between the drive rocker arm and the free rocker arm for selectively connecting and disconnecting them with a coupling pin movable in a direction substantially normal to the axis of the rocker shaft.

12 Claims, 6 Drawing Sheets

FIG. 3.
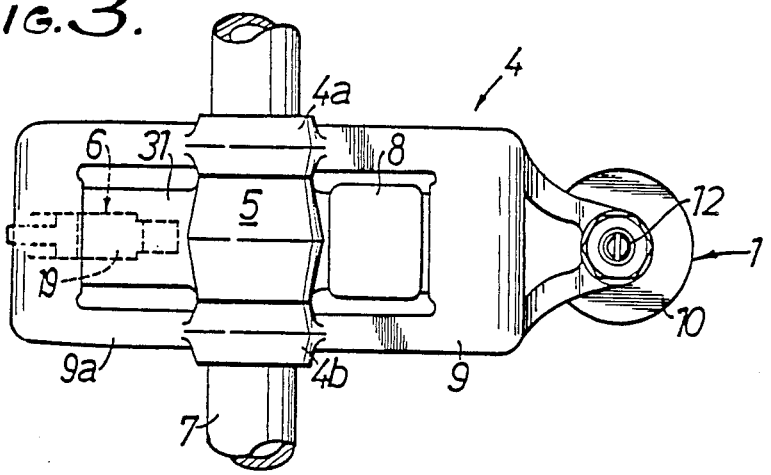
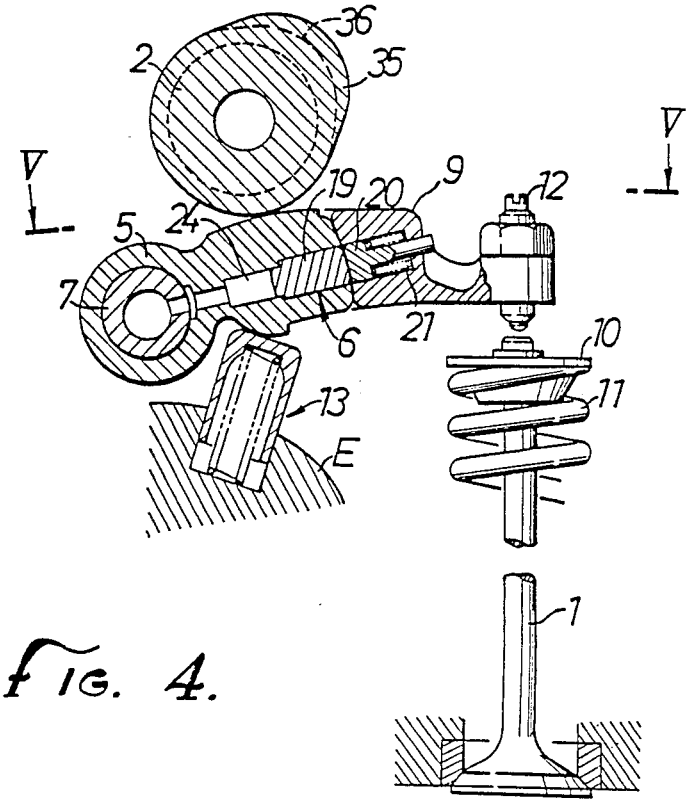
FIG. 4.

VALVE OPERATING DEVICE FOR INTERNAL COMBUSTION ENGINE

The present invention relates to a valve operating device for an internal combustion engine having a drive rocker arm operatively associated with an intake or exhaust valve, a free rocker arm releasable from the intake or exhaust valve, the drive rocker arm and the free rocker arm being pivotally supported on a rocker shaft and operable selectively in mutually different modes by different cams on a rotating camshaft, and a selective coupling mechanism disposed between the drive rocker arm and the free rocker arm for selectively connecting and disconnecting the drive rocker arm and the free rocker arm.

Heretofore, valve operating devices of the type described above are known, as disclosed for example in U.S. Pat. Nos. 4,537,164; 4,537,165; 4,545,342; 4,535,732; 4,656,977; 4,612,884; 4,576,128; 4,587,936; 4,617,880; 4,612,887; 4,611,558; and 4,607,600.

With many of the above conventional arrangements, a selective coupling mechanism has a coupling pin movable in a direction parallel to the axis of the rocker shaft. When the rocker arms that are disconnected from each other and operating in different modes are interconnected by the coupling pin, the movement of one of the rocker arms that is disposed adjacent to the other rocker arm along the axis of the rocker shaft causes the other rocker arm to move therewith. At this time, a rotational moment is applied to the rocker arm about an axis normal to the rocker shaft in a plane including the axis of the rocker shaft and the coupling pin. The moment thus applied causes cam slippers on the rocker arms and associated cams to abut in localized areas, resulting in localized wear on the cam slippers and the cams.

The present invention has been made in view of the aforesaid drawback. It is an object of the present invention to provide a valve operating mechanism for an internal combustion engine, in which no moment acts on rocker arms when they are interconnected by a selective coupling mechanism.

According to one type of embodiment of the present invention, one or the other of a drive rocker arm and a free rocker arm has a joining arm extending toward the other rocker arm, and a selective coupling mechanism is disposed between the joining arm and the other rocker arm and has a coupling pin movable in a direction substantially normal to the axis of a rocker shaft.

According to another type of embodiment of the present invention, one of a drive rocker arm and a free rocker arm has a proximal portion divided into two proximal members spaced axially of a rocker shaft with the other rocker arm disposed between the two proximal members, and also has a joining portion interconnecting the two proximal members in a substantially C-shaped configuration, and a selective coupling mechanism is disposed between the joining portion and the other rocker arm and has a coupling pin movable in a direction substantially normal to the axis of the rocker shaft.

With above arrangements, the coupling pin is moved in the direction substantially normal to the axis of the rocker shaft and controlly located relative to the cam slipper for selectively interconnecting and disconnecting the rocker arms. Therefore, no moment is imposed on the rocker arms when they are connected, and hence the cams and the associated cam slippers are prevented from localized wear.

Various embodiments of the present invention will be described hereinafter with reference to the drawings, wherein:

FIG. 3 is a plan view similar to FIG. 2 but illustrating a second embodiment of this invention;

FIG. 4 is a vertical cross-sectional view of a third embodiment of the present invention;

Figure 1:
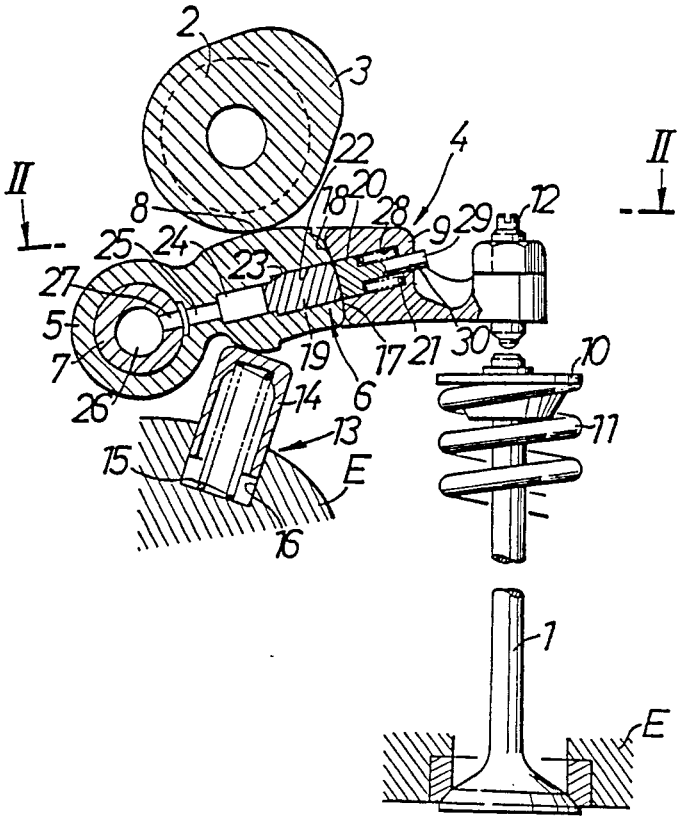
FIG. 1 is a vertical cross-sectional view of a first embodiments of the present invention.
Figure 2:
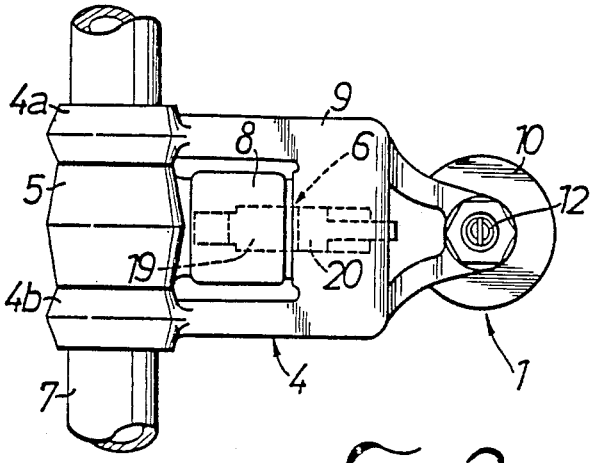
FIG. 2 is a plan view of the first embodiment taken substantially on the line II—II in FIG. 1.

In FIGS. 1 and 2 which show a first embodiment of the present invention, an intake valve 1 disposed in an engine body E is opened and closed by the coaction of a cam 3 integrally formed on a camshaft 2 rotatable by the crankshaft of the engine at a speed ratio of ½ the speed of rotation of the engine, a driver rocker arm 4 and a free rocker arm 5 which arc angularly movably supported on a rocker shaft 7 extending parallel to the camshaft 2, and a selective coupling mechanism 6 disposed between the rocker arms 4, 5.

The camshaft 2 is rotatably disposed above the engine body E. The cam 3 is integrally formed on a camshaft 2 in alignment with the intake valve 1.

The rocker shaft 7 is fixed below the camshaft 2. The free rocker arm 5 pivotably supported on the rocker shaft 7 has on its upper surface a cam slipper 8 held in slidable contact with the cam 8. The drive rocker arm 4 has a proximal portion divided into two proximal members 4*a*, 4*b* spaced axially of the rocker shaft 7 and swingably supported on the rocker shaft 7 in sandwiching relation to the free rocker arm 5.

The proximal members 4*a*, 4*b* of the drive rocker arm 4 are connected to each other by a joining portion 9 of a substantially C-shaped configuration surrounding the cam slipper 8 of the free rocker arm 5. The intake valve 1 is operatively associated with the distal end of the joining portion 9. The intake valve 1 is normally urged in a closing direction, i.e., upwardly, by a valve spring 11 disposed between a flange 10 attached to the upper end of the intake valve 1 and the engine body E. A tappet screw 12 engageable with the upper end of the intake valve 1 is adjustably threaded through the distal end of the joining portion 9.

The free rocker arm 5 is normally urged to cause the cam slipper 8 to be slidably held against the cam 3 by resilient urging means 13 disposed between the free rocker arm 5 the engine body E. The resilient urging means 13 comprises a cylindrical bottomed lifter 14 with its closed end held against the lower surface of the free rocker arm 5, and a lifter spring 15 disposed between the lifter 14 and the engine body E. The lifter 14 is slidably fitted in a bottomed hole 16 defined in the engine body E.

The distal end of the free rocker arm 5 and the drive rocker arm 4 are slidably held against each other for relative pivotal movement of the rocker arms 4, 5 about the axis of the rocker shaft 7. More specifically, the free rocker arm 5 end the drive rocker arm 4 have mutually sliding surfaces 17, 18, respectively, which are arcuate about the axis of the rocker shaft 7.

The selective coupling mechanism 6 comprises a coupling pin 19 capable of interconnecting the free rocker arm 5 and the drive rocker arm 4, a stopper 20 for limiting movement of the coupling pin 19, and a return spring 21 for normally urging the coupling pin 19 and the stopper 20 to a position to disconnect the rocker shafts 4, 5.

The free rocker arm 5 has a first guide hold 22 defined therein and opening at the sliding surface 17 toward the sliding surface 18 of the drive rocker arm 4. The first guide hole 22 extends in a direction substantially normal to the axis of the rocker shaft 7. The first guide hold 22 has a step 23 therein which faces the open end thereof. The coupling pin 19 is slidably fitted in the first guide hole 22, defining a hydraulic pressure chamber 24 between the closed end of the first guide hold 22 and the coupling pin 19. The free rocker arm 5 has an oil passage 25 defined therein and communicating with the hydraulic pressure chamber 24. The rocker shaft 7 has an oil passage 26 connected to an oil pressure supply source (not shown). The oil passages 25, 26 are held in communication with each other at all times through a communication hold 27 defined in the side wall of the rocker shaft 7, irrespective of the angular position of the free rocker arm 5.

The drive rocker arm 4 has a second guide hole 28 defined therein and opening at the sliding surface 18 toward the first guide hole 22. The second guide hole 28 extends in a direction normal to the axis of the rocker shaft 7 and has the same diameter as that of the first guide hole 22. The stopper 20 in the form of a circular plate is slidably fitted in the second guide hole 28. The stopper 20 has a coaxial smaller-diameter shaft 29 movably inserted through a guide hole 30 defined in the drive rocker arms 4 and extending through the closed end of the second guide hole 28.

Around the shaft 29, there is disposed a return spring 21 between the stopper 20 and the closed end of the second guide hole 28. The stopper 20 is normally urged by the return spring 21 in a direction to abut against the coupling pin 19 for biasing the stopper 20 and the coupling pin 19 to disconnect the rocker arms 4, 5.

The coupling pin 19 has a length selected such that when the coupling pin 19 abuts against the step 23, the mutually abutting surfaces of the coupling pin 19 and the stopper 20 are positioned flush with the sliding surfaces 17, 18.

Option of the first embodiment now will be described. During low-speed operation of the engine, no oil pressure is supplied to the hydraulic pressure chamber 24. Therefore, the coupling pin 19 and the stopper 20 are displaced the maximum stroke toward the hydraulic pressure chamber 24 under the bias of the return spring 21. In this position, the mutually abutting surfaces of the coupling pin 19 end the stopper 20 lie flush with the sliding surfaces 17, 18 allowing the free rocker arm 5 and the drive rocker arm 4 to be relatively angularly displaced.

With the selective coupling mechanism 6 thus disconnecting the rocker arms 4, 5, the free rocker arm 5 is angularly moved by sliding contact with the cam 3 in response to the rotation of the camshaft 2, but the drive rocker arm 4 is not angularly moved. The intake valve 1 thus remains closed. This condition corresponds to a mode in which selected cylinders of a multi-cylinder internal combustion engine are disabled during low-speed operation.

When the engine operates in a high-speed range, oil pressure is supplied to the hydraulic pressure chamber 24 to move the the coupling pin 19 into the second guide hole 28 while pushing the stopper 20 against the resiliency of the return spring 21. This movement of coupling pin 19 is effected when the free rocker arm 5 is slidably engaging the base-circle portion of the cam 3 and therefore the first and second guide holes 22, 29 are axially aligned with each other. Now, the free rocker arm 5 and the drive rocker arm 4 are interconnected by the coupling pin 19.

Therefore, the drive rocker arm 4 is operated with the free rocker arm 5, so that the intake valve 1 is opened and closed at the timing and lift according to the cam profile of the cam 3.

When the free rocker arm 5 and the drive rocker arm arc interconnected in this manner, the axis of the coupling pin 19 is directed perpendicular to the axis of the rocker shaft 7 and is centered on the rocker arm 5, as viewed in FIG. 2. Therefore, no moment is applied to the rocker arms 4, 5 about the axis of the coupling pin 19. The cam 3 and the cam slipper 8 are prevented from engaging each other at a localized area and hence from localized wear.

FIG. 3 shows a second embodiment of the present invention. Those parts which are identical to those of the first embodiment are denoted by identical reference numerals.

The two proximal members **4*a*, 4*b* of the drive rocker arm 4 are joined to the joining portion 9 of a substantially C-shaped configuration surrounding the cam slipper 8 of the free rocker arm 5 and operatively associated at the distal end with the intake valve 1, and to another joining portion 9*a* of a substantially C-shaped configuration extending remotely from the intake valve 1. The free rocker arm 5 has a projection 31 extending toward the distal end of the joining portion 9*a*. The projection 31 and the joining portion 9*a* are held in slidable contact with each other. The selective coupling mechanism 6 having the coupling pin 19 movable in a direction normal to the axis of the rocker shaft 7 is disposed between the projection 31 and the joining portion 9*a***.

The second embodiment offers the same advantages as those of the first embodiment.

Figure 5:
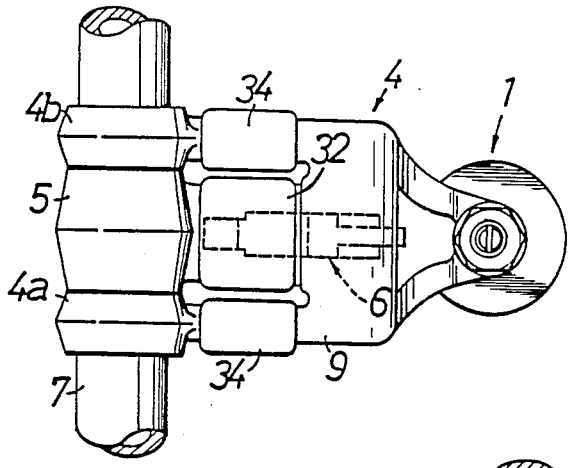
FIG. 5 is a plan view of the third embodiment taken substantially on the line V—V in FIG. 4.

FIGS. 4 and 5 illustrate a third embodiment of the present invention. The free rocker arm 5 has a cam slipper 32 held in slidable contact with a high-speed cam 35. Two low-speed cams 36 are integrally formed on the camshaft 2 and disposed one on each side of the high-speed cam 35. The joining portion 9 of the rocker arm 4 has two cam slippers 34 slidably held against the low-speed cams 36, respectively.

During low-speed operation of the engine, the selective coupling mechanism 6 is kept inoperative to allow the intake valve 1 to be opened and closed at the timing and lift according to the cam profile of the low-speed cams 36. During high-speed operation of the engine, the free rocker arm 5 and the drive rocker arm 4 are interconnected by the selective coupling mechanism 6 to cause the intake valve 1 to be opened and closed at the timing and lift according to the cam profile of the low-speed cams 36. During high-speed operation of the engine, the free rocker arm 5 and the drive rocker arm 4 are interconnected by the selective coupling mechanism 6 to cause the intake valve 1 to be opened and closed at the timing and lift according to the cam profile of the high-speed cam 35. No undesired moment is imposed on the rocker arms 4, 5 as with the previous embodiments.

Figure 6:
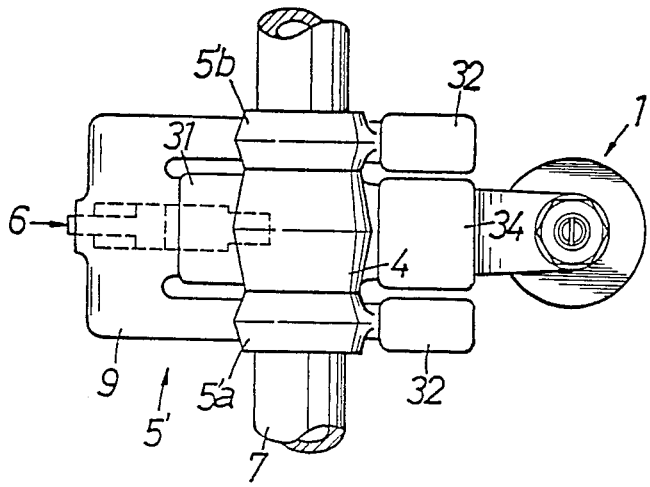
FIGS. 6 through 15 are plan views similar to FIGS. 2, 3 and 5 showing fourth through thirteenth embodiments of the present invention.

FIG. 6 shows a fourth embodiment of the present invention. The drive rocker arm 4 operatively associated with the intake valve 1 has a cam slipper 34 slidably held against a low-speed cam. A free rocker arm 5' has two divided proximal members 5'a, 5'b sandwiching the drive rocker arm 4 therebetween and also has two cam slippers 32 slidably held against respective high-speed cams. The free rocker arm 5' also has a joining portion 9 interconnecting the proximal members 5'a, 5'b remotely from the intake valve 1. The selective coupling mechanism 6 is disposed between the joining portion 9 and a projection 31 projecting from the drive rocker arm 4 in slidable contact with the joining portion 9.

The fourth embodiment operates in the same manner as and has the same advantages as the third embodiment.

Figure 7:
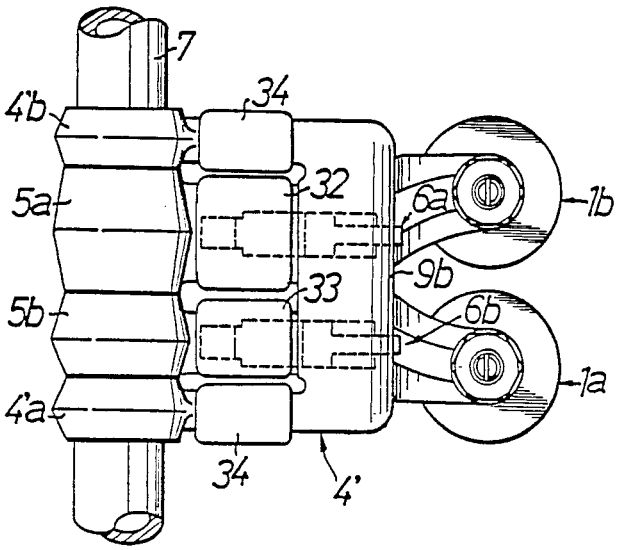

FIG. 7 shows a fifth embodiment of the present invention. A drive rocker arm 4' is operatively associated with a pair of intake valves 1a, 1b and has two proximal members 4'a, 4'b between which first and second free rocker arms 5a, 5b adjacent to each other are swingably supported on the rocker shaft 7. The first free rocker arm 5a has a cam slipper 32 held in slidable contact with a high-speed cam (not shown), and the second free rocker arm 5b has a cam slipper 33 held in slidable contact with a medium-speed cam (not shown). The two proximal members 5a, 5b arc interconnected by a joining portion 9b having a pair of cam slippers 34 slidably held against respective low-speed cams (not shown). A first selective coupling mechanism 6a is disposed between the first free rocker arm 5a and the joining portion 9b, and a second selective coupling mechanism 6b is disposed between the second free rocker arm 5b and the joining portion 9b, each of the first and second coupling mechanisms 6a, 6b being identical in structure to the selective coupling mechanism 6. The first and second coupling mechanisms 6a, 6b are operable independently of each other.

According to the fifth embodiment, during low-speed operation of the engine, the selective coupling mechanisms 6a, 6b are in the rocker arm disconnecting position, so that the intake valves 1a, 1b are opened and closed by the low-speed cams. During medium-speed operation of the engine, the second selective coupling mechanism 6b is in the rocker arm connecting position, and the first selective coupling mechanism 6a is in the rocker arm disconnecting position. Therefore, the second free rocker arm 5b and the drive rocker arm 4' are interconnected to cause the intake valves 1a, 1b to be opened and closed by the medium-speed cam. During high-speed operation of the engine, the selective coupling mechanisms 6a, 6b are in the rocker arm connecting position to couple the rocker arms 4', 5a, 5b together, so that the intake valves 1a, 1b are opened and closed by the high-speed cam. The second selective coupling mechanism 6b may be in the rocker arm disconnecting position during high-speed operation of the engine.

Figure 8:
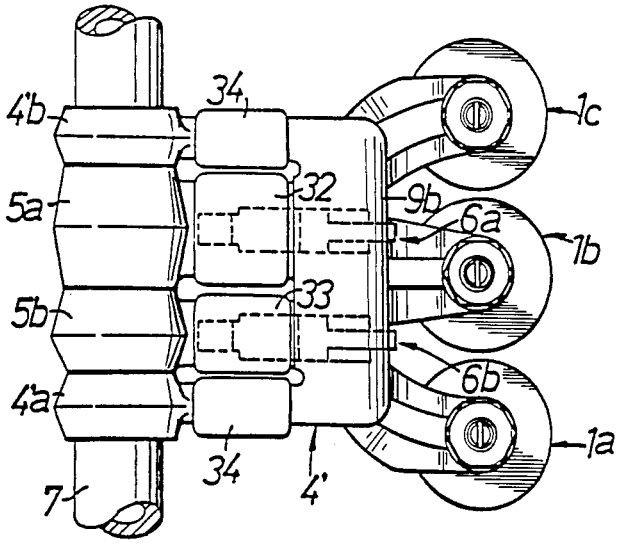
Figure 9:
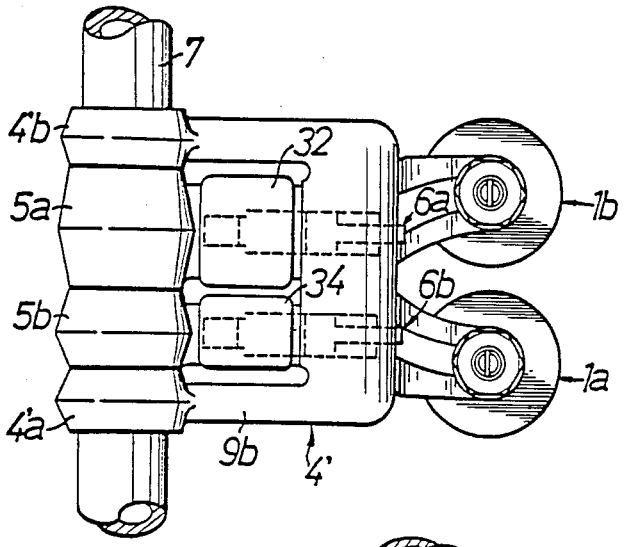

According to a sixth embodiment shown in FIG. 8, which is a modification of the fifth embodiment, three intake valves 1a, 1b, 1c are operatively associated with the drive rocker arm 4'.

FIG. 7 shows a seventh embodiment of the present invention. The second free rocker arm 5b has a cam slipper 34 slidably held against a low-speed cam and there are no cam slippers 34 on the drive rocker arm 4'. According to the seventh embodiment, when the selective coupling mechanisms 6a, 6b are in the rocker arm disconnecting position, the intake valves 1a, 1b remain closed or are held at rest. When the second selective coupling mechanism 6b is in the rocker arm connecting position, the intake valves 1a, 1b are opened and closed by the low-speed cam. When the first selective coupling mechanism 6a is in the rocker arm connecting position, the intake valves 1a, 1b are opened and closed by the high-speed cam.

With the present invention, as described, above, one of the drive rocker arm and the free rocker arm has a proximal portion divided into two proximal members spaced axially of the rocker shaft with the other rocker arm disposed between the two proximal members, and also has a joining portion interconnecting said two proximal members in a substantially C-shaped configuration, and a selective coupling mechanism is disposed between the joining portion and the other rocker arm and has a coupling pin movable in a direction substantially normal to the axis of the rocker shaft. When the rocker arms are interconnected by the coupling pin, no moment is applied to the rocker arms. Therefore, the cam and the cam slipper are prevented from slidably contacting each other at a localized area and hend from localized wear.

The eighth through thirteenth embodiments of this invention shown in FIGS. 10 through 15 differ from the previously described embodiments in only one principle respect, namely, there is no rocker arm with two portions pivotally mounted on the rocker shaft and interconnected to form a C-shape. In all other respects these embodiments are the same or substantially similar.

Figure 10:
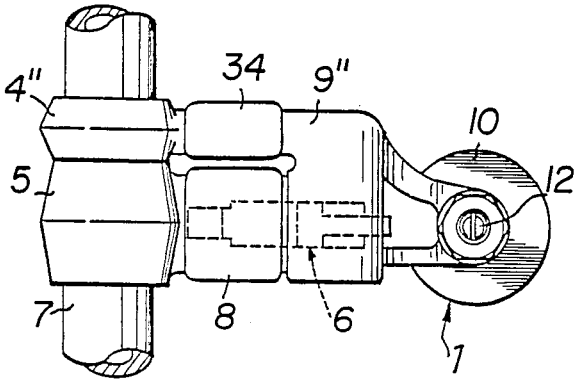

FIG. 10 shows an eighth embodiment wherein a drive rocker arm 4' has a cam slipper 34 held against a low-speed cam (not shown) and a free rocker arm 5 has a cam slipper 8 held against a high-speed cam (not shown). The drive rocker 4' has an integral joining arm 9' bent toward the free rocker arm 5 and extending parallel to the rocker shaft 7. The intake valve 1 is operatively associated with the distal end of the joining arm 9'. The distal end of the free rocker arm 5 and the joining arm 9 of the drive rocker arm are slidable against each other for relative swinging motion and can be joined selectively by the coupling mechanism 6, which operates in the same manner as the previously described coupling mechanisms. When the engine is operating at low-speed, the coupling mechanism 6 is not actuated and therefore the drive rocker 4' and free rocker arm 5 freely pivot relative to each other whereby the valve 1 is operated by the low-speed cam (not shown) engaging the cam slipper 34 of the drive rocker arm 4'. When the engine is operated at high speed, the coupling mechanism 6 is actuated to connect the two rocker arms and therefore the valve 1 is operated by the high-speed cam engaging the cam slipper 8 on the free rocker arm 5.

When the free rocker arm 5 and the drive rocker arm 4' arc interconnected in this manner, the axis of the coupling pin 22 is directed perpendicular to the axis of the rocker shaft 6 and centrally of the rocker arm 5, as viewed in FIG. 10. Therefore, no moment is applied to the rocker arms 4' and 5 about the axis of the coupling pin 22. The low-speed cam and the cam slipper 34 and the high-speed cam and the cam slipper 8 are prevented from engaging each other at a localized area and hence from localized wear.

Figure 11:
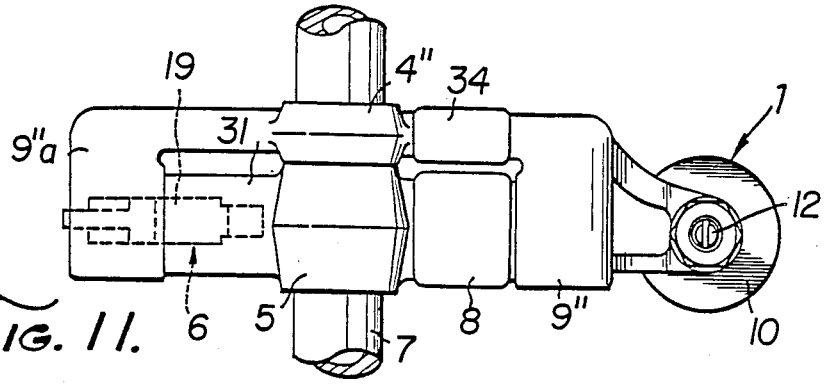

FIG. 11 shows a ninth embodiment of the present invention. The drive rocker arm 4' has an integral joining arm 9a' of a substantially L-shaped configuration extending toward the free rocker arm 5 remotely from the joining arm 9'. The free rocker arm 5 has a projection 31 extending into slidable contact with the joining arm 9a'. The selective coupling mechanism 6 having the coupling pin 19 movable in a direction normal to the axis of the rocker shaft 7 is disposed between the projection 31 and the joining arm 9a'.

Figure 12:
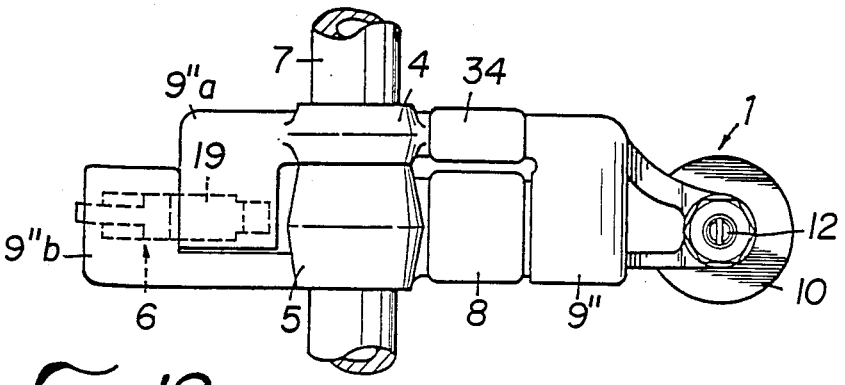

FIG. 12 shows a tenth embodiment of the present invention. A first free rocker arm 5a has a cam slipper 32 held in slidable contact with a high-speed cam (not shown), and a second free rocker arm 56 has a cam slipper 33 held in slidable contact with a medium-speed cam (not shown). The first and second free rocker arms 5a, 5b are pivotably supported on the rocker shaft 7 adjacent to each other. A pair of drive rocker arms 4a', 4b' operatively associated with a pair of intake valves 1 and having respective cam slippers 34 held in slidable contact with low-speed cams (not shown) are pivotably supported on the rocker shaft 7 one on each side of the first and second free rocker arms 5a, 5b. Between the joining arms 9' of the drive rocker arms 4a', 4b' and the free rocker arms 5a, 5b, there are disposed selective coupling mechanisms 6, respectively, each having a coupling pins 19 movable in a direction normal to the axis of the rocker shaft 8.

Figure 13:
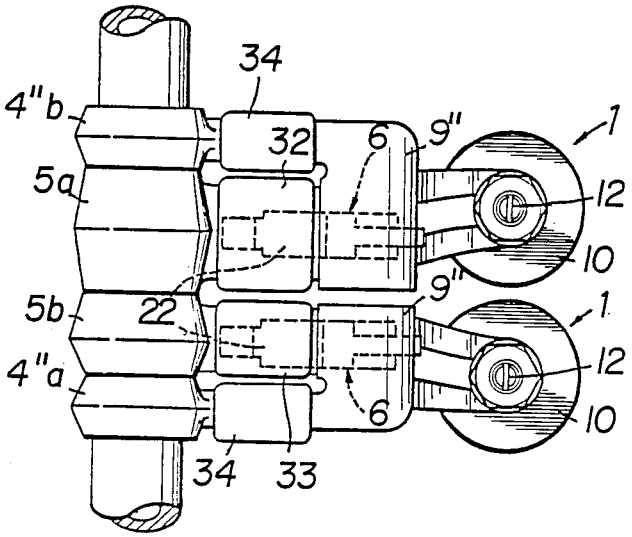
Figure 14:
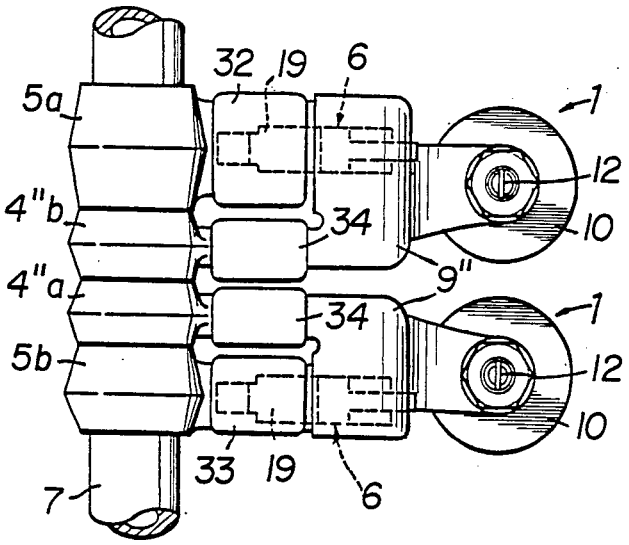

The twelfth embodiment shown in FIG. 14 is very similar to the eleventh embodiment of FIG. 13, except that the respective locations of the drive rocker arms 4a', 4b' and the free rocker arms 5a, 5b are reversed. According to these embodiments, during low-speed operation of the engine, the selective coupling mechanisms 6 are in the rocker arm disconnecting position, so that the intake valves 1 are opened and closed at the timing and lift according to the cam profile of the low-speed cams. During medium-speed operation of the engine, one of the selective coupling mechanisms 6 interconnects one of the drive rocker arms 4a' and the second free rocker arm 5b, whereas the other drive rocker arm 4b' and the first free rocker arm 5a are disconnected from each other. Therefore, one of the intake valves 1 is opened and closed at the timing and lift according to the cam profile of the medium-speed can, and the other intake valve 1 is opened and closed at the timing and lift according to the cam profile of the low-speed cam. During high-speed operation of the engine, while the second free rocker arm 5b and one of the drive rocker arms 4a' are being interconnected by the selective coupling mechanism 6. One of the intake valves 1 is opened and closed at the timing and lift according to the cam profile of the medium-speed cam, whereas the other intake valve 1 is opened and closed at the timing and lift according to the cam profile of the high-speed cam. As with the previous embodiments, no moment acts on the rocker arms 4a', 4b', 5a, 5b when they are coupled by the selective coupling mechanisms 6.

Figure 15:
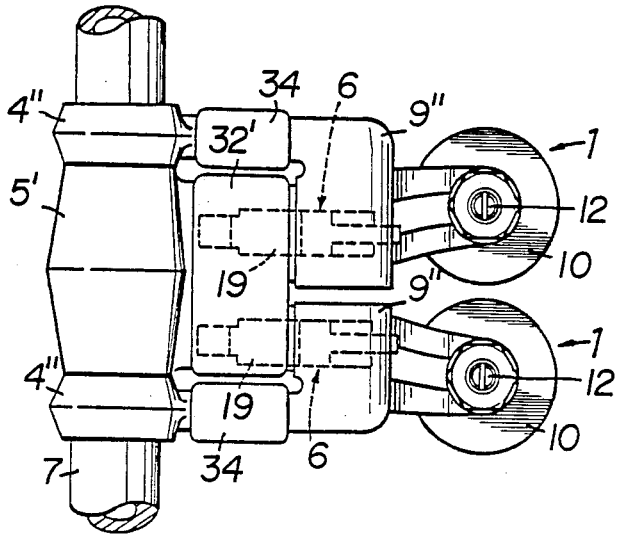

FIG. 15 shows a thirteenth embodiment of the present invention. A free rocker arm 5' pivotably supported on the rocker shaft 7 has a cam slipper 32' slidably held against a high-speed cam (not shown). The drive rocker arms 4' operatively associated with the intake valves 1 and having respective cam slippers 34 slidably held against respective low-speed cams (not shown) are pivotably supported on the rocker shaft 7, one on each side of the free rocker arm 5'. Between the free rocker arm 5' and the joining arms 9; of the drive rocker arms 4', there are disposed two selective coupling mechanisms 6 having respective coupling pins 19 movable in a direction normal to the axis of the rocker shaft 7. According to this thirteenth embodiment, when one of the selective coupling mechanisms 6 is operated to interconnect the free rocker arm 5' and one of the drive rocker arms 4', one of the intake valves 1 is opened and closed at the timing and lift according to the cam profile of the high-speed cam. When the selective coupling mechanisms 6 are in the rocker arm connecting position, the intake valves 1 are opened and closed at the timing and lift according to the cam profile of the high-speed cam.

In each of the embodiments shown in FIGS. 13, 14 and 15, only one of the drive rocker arms 4' may be held in slidable contact with the low-speed cam, and the other drive rocker arm 4' may be held out of slidable contact with the low-speed cam. With this alternative, the intake valve associated with the other drive rocker arm remains closed when the associated selective coupling mechanism is in the rocker arm disconnecting position.

While the present invention has been described as being applied to an intake valve or intake valves, the invention is also applicable to a valve operating mechanism for an exhaust valve or exhaust valves.

With the present invention, as described above with respect to FIGS. 10 through 15, one of the drive rocker arm and the free rocker arm and the free rocker arm has a joining arm extending to the other rocker arms, and a selective coupling pin movable in a direction substantially normal to the axis of the rocker shaft. When the rocker arms are interconnected by the coupling pin, no moment is applied to the rocker arms. Therefore, the cam and the cam slipper are prevented from slidably contacting each other at a localized area and hence from localized wear.

What is claimed is:

1. A valve operating device for an internal combustion engine having a pair of rocker arms pivotally mounted on a rocker shaft and separately operable by different cams on a camshaft for different modes of operation of an intake or exhaust valve operatively connected to one of said rocker arms, comprising each rocker arm having a portion with a surface substantially parallel to and confronting said surface of the other rocker arm, coupling means in said portions for selectively coupling said rocker arms including a coupling pin movable in a direction substantially perpendicular to the axis of the rocker arm shaft.

2. A valve operating device for an internal combustion engine having a drive rocker arm operatively connected to an intake or exhaust valve, a free rocker arm adjacent the driver rocker arm, both rocker arms being pivotally mounted on a rocker shaft and being pivotable by separate cams on a rotating camshaft to pivot in different modes, and a coupling mechanism for selectively connecting and disconnecting said rocker arms for selectively operating the valve in different modes, an improvement comprising, a joining arm portion on one of said rocker arms extending toward the other rocker arm, the coupling mechanism being at least partially disposed in said joining arm portion, and said coupling mechanism including a coupling pin movable substantially perpendicular to the axis of the rocker shaft for causing said selective connecting and disconnecting of the rocker arms.

3. The valve operating device of claim 2 wherein the coupling pin is hydraulically actuated by oil pressure supplied from a passage in the rocker shaft through a passage in one of the rocker arms.

4. The valve operating device of claim 3 wherein the coupling pin is actuated by said oil pressure to connect the rocker arms.

5. The valve operating device of claim 4 wherein said coupling mechanism includes a spring urging said coupling pin in a direction for disconnecting the rocker arms.

6. The valve operating device of claim 2 wherein the free rocker arm has a cam slipper surface engaging a cam, and said coupling pin is centrally aligned with said cam slipper surface in the direction of the rocker shaft axis.

7. The valve operating device of any one of claims 2, 3, 4, 5 or 6 wherein said joining arm portion is located between the rocker shaft and the valve.

8. The valve operating device of claim 7 wherein said drive rocker arm includes two proximal portions pivotally mounted on the rocker shaft with the free rocker arm pivotally mounted therebetween on the rocker shaft.

9. The valve operating device of any one of claims 2, 3, 4, 5 or 6 wherein said joining arm portion is located on a side of the rocker shaft remote from a portion of the drive rocker arm that is operatively connected to the valve.

10. The valve operating device of claim 9 wherein said drive rocker arm includes two proximal portions pivotally mounted on the rocker shaft with the free rocker arm pivotally mounted therebetween on the rocker shaft.

11. The valve operating device of claim 2 wherein said joining arm portion has a curved surface parallel to and coincident with a radius of the rocker shaft, a like surface on the other rocker arm in facing relationship, and said coupling pin movable through the planes of said two surfaces.

12. The valve operating device of claims 2, 3, 4, 5, 6 or 11 wherein said drive rocker arm includes two proximal portions pivotally mounted on the rocker shaft, two said free rocker arms are pivotally mounted on said rocker shaft between said proximal portions of the drive rocker arm, each free rocker arm engaging a different shaft cam for different modes of operation, and a separate selectively operable coupling mechanism in each free rocker arm for selectively connecting or the other of said two free rocker arms to said drive rocker arm.

* * * * *